US009410365B2

(12) United States Patent
Hashemi

(10) Patent No.: US 9,410,365 B2
(45) Date of Patent: Aug. 9, 2016

(54) THERMAL SHUTTER SYSTEM

(75) Inventor: Arman Hashemi, Staffordshire (GB)

(73) Assignee: WJP HOLDINGS LIMITED (GB)

( * ) Notice: Subject to any disclaimer, the term of this patent is extended or adjusted under 35 U.S.C. 154(b) by 0 days.

(21) Appl. No.: 13/261,706

(22) PCT Filed: Feb. 2, 2012

(86) PCT No.: PCT/EP2012/051803

§ 371 (c)(1),
(2), (4) Date: Aug. 6, 2013

(87) PCT Pub. No.: WO2012/107350

PCT Pub. Date: Aug. 16, 2012

(65) Prior Publication Data

US 2014/0000164 A1 Jan. 2, 2014

(30) Foreign Application Priority Data

Feb. 8, 2011 (GB) ..... 1102111.0

(51) Int. Cl.

| | |
|---|---|
| ***E06B 9/302*** | (2006.01) |
| ***E06B 7/094*** | (2006.01) |
| ***E05F 15/70*** | (2015.01) |

(52) U.S. Cl.

CPC ..... *E06B 9/302* (2013.01); *E05F 15/70* (2015.01); *E06B 7/094* (2013.01)

(58) Field of Classification Search

CPC ... E06B 3/5063; E06B 9/0676; E06B 9/0638; E06B 9/302; E06B 7/094; E05F 15/20; E05F 15/70

USPC ..... 160/5, 2, 205, 184, 188, 220, 88, 180; 49/82.1, 80.1, 74.1, 136, 168, 371, 142

See application file for complete search history.

(56) References Cited

U.S. PATENT DOCUMENTS

| | | | | |
|---|---|---|---|---|
| 2,232,372 | A * | 2/1941 | Dierker | E06B 3/925 49/126 |
| 2,861,836 | A * | 11/1958 | Goeggel | B60J 7/047 160/193 |
| 3,810,330 | A * | 5/1974 | Daggy | E05D 15/58 49/127 |
| 4,062,394 | A | 12/1977 | Anderson | |
| 4,279,240 | A * | 7/1981 | Artusy | 126/579 |
| 7,111,952 | B2 * | 9/2006 | Veskovic | 362/1 |
| 7,617,857 | B2 * | 11/2009 | Froese | E06B 9/386 160/10 |
| 2003/0098133 | A1 * | 5/2003 | Palmer | 160/310 |
| 2008/0210388 | A1 * | 9/2008 | Padan | E06B 3/927 160/201 |
| 2014/0000164 | A1 * | 1/2014 | Hashemi | 49/31 |

FOREIGN PATENT DOCUMENTS

| | | | |
|---|---|---|---|
| DE | 20 2006 018968 | U1 | 3/2007 |
| GB | 885 992 | A | 1/1962 |
| WO | WO 2008/006177 | A1 | 1/2008 |
| WO | WO 2009/100861 | A1 | 8/2009 |

* cited by examiner

*Primary Examiner* — Blair M Johnson
(74) *Attorney, Agent, or Firm* — Ira S. Dorman

(57) ABSTRACT

A thermal shutter system comprises a plurality of elongate shutters (1). The shutters are mounted for rotation about the elongate direction thereof and are mounted for movement in a direction substantially perpendicular to the elongate direction. Each shutter is movable independently of the other shutter or shutters.

15 Claims, 9 Drawing Sheets

THERMAL SHUTTER SYSTEM

The present invention relates to a thermal shutter system, for example for windows.

Energy conservation is becoming increasingly important in the construction industry. Windows are one of the major areas of heat loss in buildings. Considering the current building regulations in the United Kingdom, windows can lose up to 10 times more energy than other building elements. Therefore, the tendency is to decrease the size of windows. However, reduction in window size in order to save energy conflicts with the desire for larger windows for increased natural lighting, solar heat gain, ventilation and architectural reasons. Moreover, old windows may fall significantly below the current standards and suffer even more heat loss. Although old-fashioned windows may offer a pleasant environment in terms of external view and natural lighting, their poor thermal insulation properties may necessitate re-glazing. As an alternative, retrofitted thermal shutters may be considered to enhance the thermal properties of such windows while retaining their desirable properties. There is therefore a need to address the above issues by developing an advanced thermal window shutter to make a balance between energy efficiency, natural lighting, ventilation and architectural design requirements.

It is therefore an object of the present invention to provide a thermal shutter system, for example for windows, which provides energy efficiency irrespective of window size.

According to the present invention there is provided a thermal shutter system comprising a plurality of elongate shutters, the shutters being mounted for rotation about the elongate direction thereof and being mounted for movement in a direction substantially perpendicular to the elongate direction, each shutter being movable independently of the other shutter or shutters.

The shutters may be arranged in pairs of subsidiary shutters positioned end-to-end. The subsidiary shutters of each pair may be mounted for independent rotation, but simultaneous movement perpendicular to the elongate direction. The shutters may be mounted within a frame. The frame may incorporate a seal for sealing against a surface to which the frame is secured.

A seal, such as a brush seal or an elastomeric seal, may be provided between the shutters and the frame and/or between adjacent shutters.

The shutters may be mounted for rotation about an axis positioned adjacent to a longitudinal edge of the shutter. The axis may be positioned within the shutter.

Alternatively, the shutters may be arranged in planes offset from the axis about which they are rotatable. In this case, the shutters may be rotatable to two alternative closed configurations, one in which the ends of the shutters abut against a seal and another in which the ends of the shutters are spaced from the seal.

The shutters may be substantially rectangular.

The shutter blades may be opaque, translucent or transparent. The shutters may be made of or filled with a thermal insulation material. However, if used primarily as a sun shade it is not necessary for the shutter blades to be made of or filled with a thermal insulation material. If desired, the shutter blades may be provided, at least on one face thereof, with a solar panel so as to generate all or part of the energy required for the thermal shutter system to function.

At least one face of at least one of the shutters may be made of or provided with a reflective material.

The shutters may be mounted on a plurality of linear members, for example extending within the frame. The shutters may be mounted for rotation and for movement relative to the linear members. A drive mechanism may be provided for the shutters.

The drive mechanism may, for example, comprise a pick and place mechanism. The pick and place mechanism may include a sensor adapted to uniquely identify each shutter of the system, for example an optical sensor adapted to recognise a visual code, such as a unique identification code, provided on each shutter.

Means may be provided for recording the elevation and degree of rotation of each shutter. Such means may include a mechanism for controlling the elevation and degree of rotation of each shutter.

For a better understanding of the present invention and to show more clearly how it may be carried into effect reference will now be made, by way of example, to the accompanying drawings in which.

The thermal shutter system shown in FIGS. 1 to 4 is provided over an internal face of an opening, such as a window, in a building and comprises a plurality of shutter blades 1 which are mounted within a frame 3. The frame 3 may be secured to an internal face of a building by way of a seal 9 in order to make the shutter system relatively air-tight. In an analogous manner, the thermal shutter system may be provided externally of a building. For example, in hot climates it may be preferable to mount the thermal shutter system externally of a building in order that it can act as a solar shade and decrease the cooling load within the building.

Figure 1:
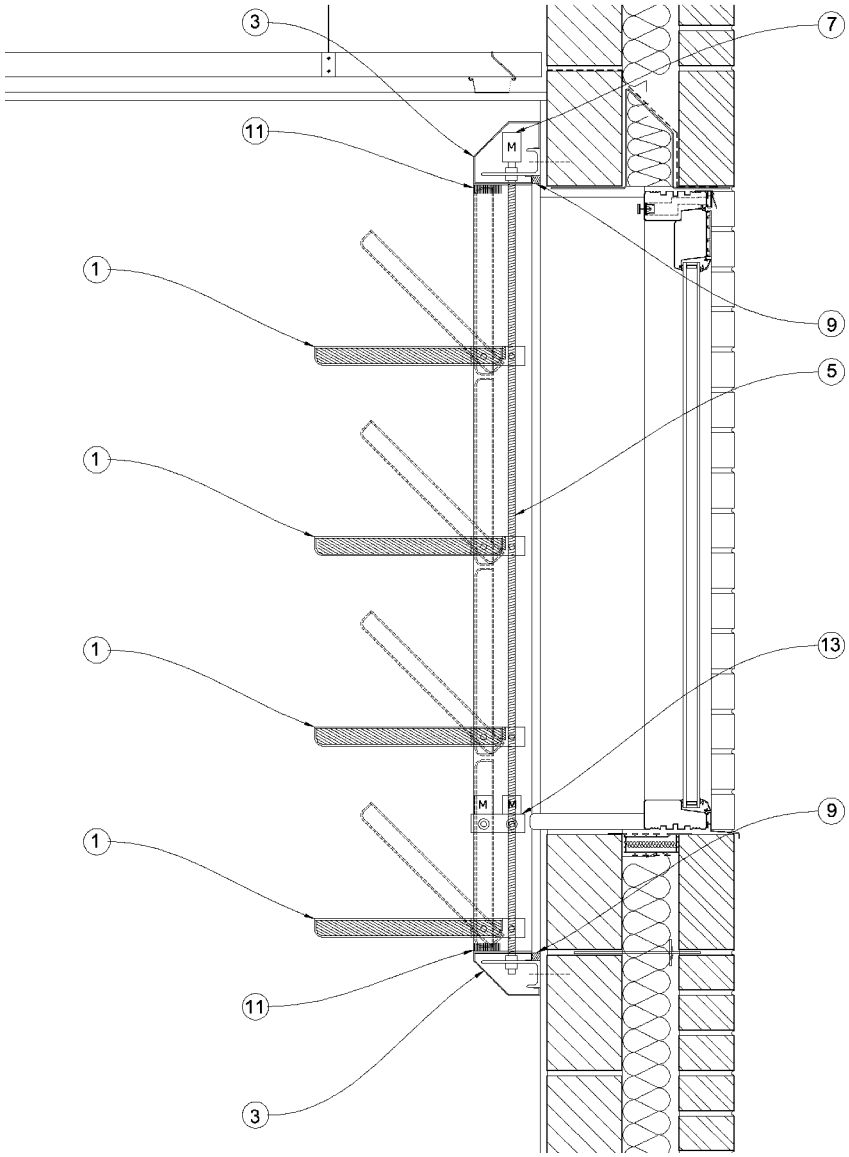
FIG. 1 is a sectional view through one embodiment of a thermal shutter system according to the present invention in a first configuration.

The shutter blades 1 are substantially rectangular and are each mounted so as to be pivotable about a substantially horizontal axis positioned adjacent to a longitudinal edge, but within, the blade. However, it will be apparent that other pivotal mounting arrangements are possible. It will also be apparent that the shutter blades could have other configurations, such as curved, and that the pivot axes of the shutter blades could be upright rather than horizontal. The following description, however, relates to the pivot axes of the shutter blades 1 being in a horizontal configuration. FIG. 1 shows the blades in several alternative positions, namely, substantially horizontal, substantially vertical and inclined to both the horizontal and the vertical. The shutter blades 1 are made of or filled with a thermal insulation material in order to provide thermal efficiency. For example, the shutter blades may incorporate one or more vacuum insulating panels (VIPs). The shutter blades may be opaque, translucent or transparent. If used primarily as a sun shade it is not necessary for the shutter blades to be made of or filled with a thermal insulation material. If desired, the shutter blades may be provided, at least on one face thereof, with a solar panel so as to generate all or part of the energy required for the thermal shutter system to function.

The shutter blades 1 are mounted on a plurality of upright members 5 in such a manner that the blades are pivotable about the horizontal axis and such that the blades are movable upwardly and downwardly relative to the upright members. The blades may be movable upwardly and downwardly and may be pivoted by a number of different drive mechanisms. For example, one or more of the upright members may be threaded and may engage with a threaded member supporting a blade such that rotation of the upright member 5 by an electric motor 7 directly causes the blade to move upwardly or downwardly. Alternatively, a belt drive may be provided extending between upper and lower regions of the frame 3 and engaging with one or more of the blades such that operation of the belt drive causes the blade or blades to move upwardly or downwardly. In cases where more than one blade is operated by the drive mechanism it is preferable that the drive mechanism can be released from each blade separately in order that each blade can be positioned independently of the other blade or blades. As a further alternative, each blade may be provided with its own drive mechanism, including at least one motor and at least one gearbox for each blade, which drive mechanism is operable independently of the drive mechanism(s) for the other blade or blades. In another alternative, a pick and place mechanism 13 is provided which is movable upwardly and downwardly and is capable of engaging any one of the shutter blades 1 to move the blade to a desired location. This alternative is illustrated for information only. A seal 11, such as a brush seal or an elastomeric seal, may be provided on the frame 3 between the frame and at least the uppermost and lowermost edges of the shutter blades 1 and corresponding seals may be provided between adjacent shutter blades. Balanced movement of the shutter blades may be achieved by synchronising the gearboxes and motors, for example by electronic or mechanical means.

It will be clear to the skilled person that at least some of the various drive means may be used in combination. For example, each blade may have a set of one or more gearboxes and one or more driving motors for moving and/or rotating the blade, but such gearboxes may engage or disengage from one or more common drives and/or a pick and place mechanism if desired.

The upward and downward movement of the shutter blades combined with the pivoting movement allow the blades to be positioned in a number of ways. As shown more clearly in FIG. 2, the blades may be moved to an upright configuration in which the thermal shutter system is closed so as to function as a thermally insulating barrier between the interior of a building and the window covered by the shutter system. Such an arrangement reduces heat loss and air leakage from the building and eliminates glare. Intermediate configurations may be employed to determine the amount of light entering the building and the manner in which that light is distributed within the building. Alternatively, as shown in FIG. 3 the blades may be moved to a generally horizontal configuration and one or more of the blades may be used as a light shelf. In such a configuration, a number of the blades may be stacked at the bottom (as shown) and/or the top of the frame 3 with one or more of the blades positioned to reflect light into the building in such a way as to reduce glare. At least the reflecting face of one or more of the blades may be made of or provided with a suitable reflective material. A reflecting face is also useful when the shutter blades are being used as a thermal barrier.

Figure 2:
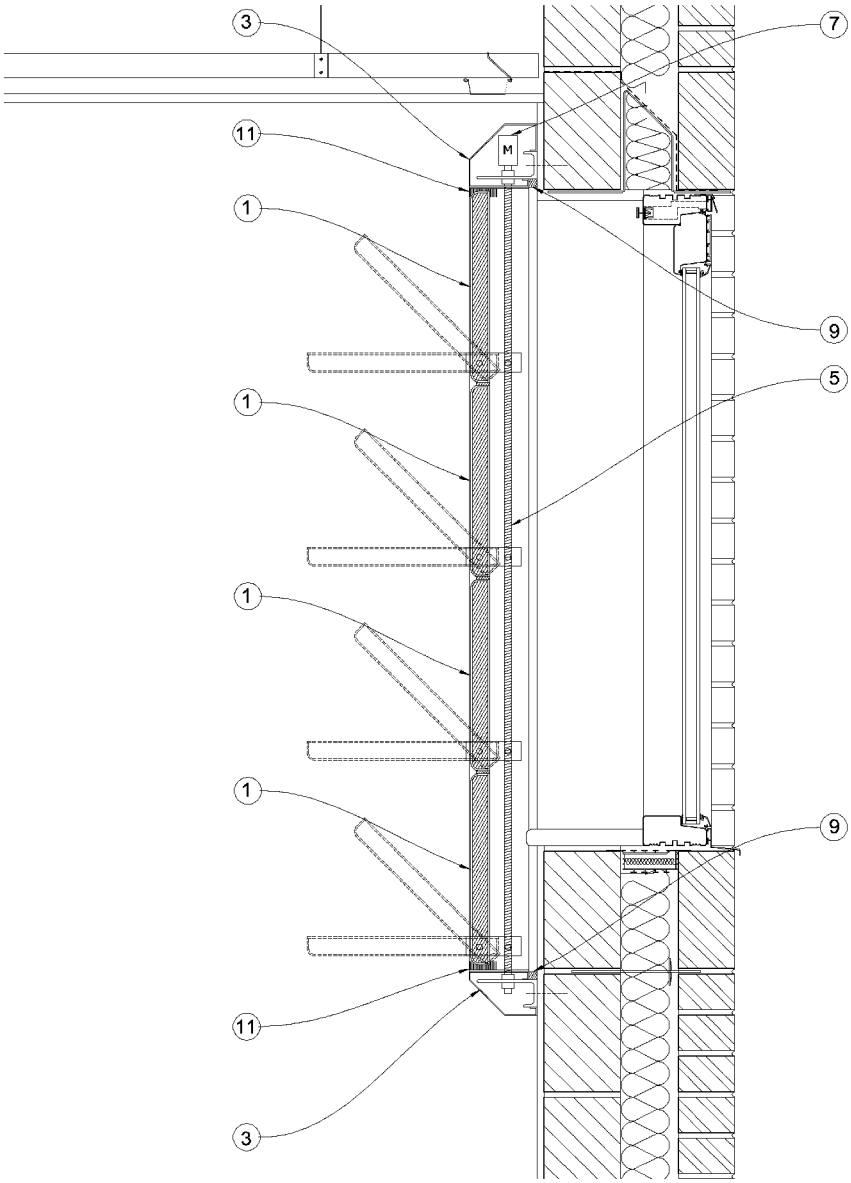
FIG. 2 is a sectional view corresponding to that of FIG. 1 with the thermal shutter system in a second configuration.
Figure 3:
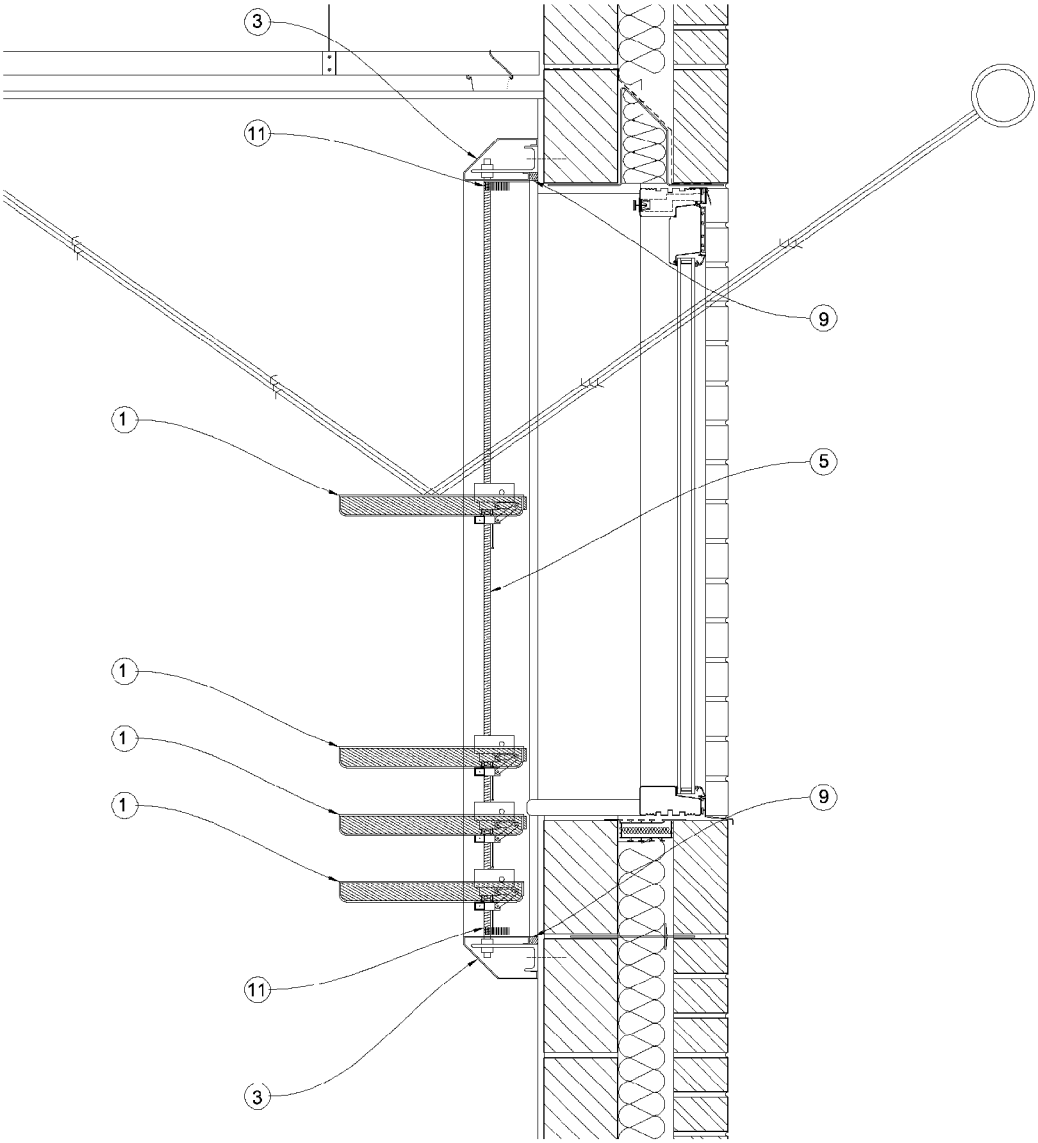
FIG. 3 is a sectional view corresponding to that of FIG. 1 with the thermal shutter system in a third configuration.
Figure 4:
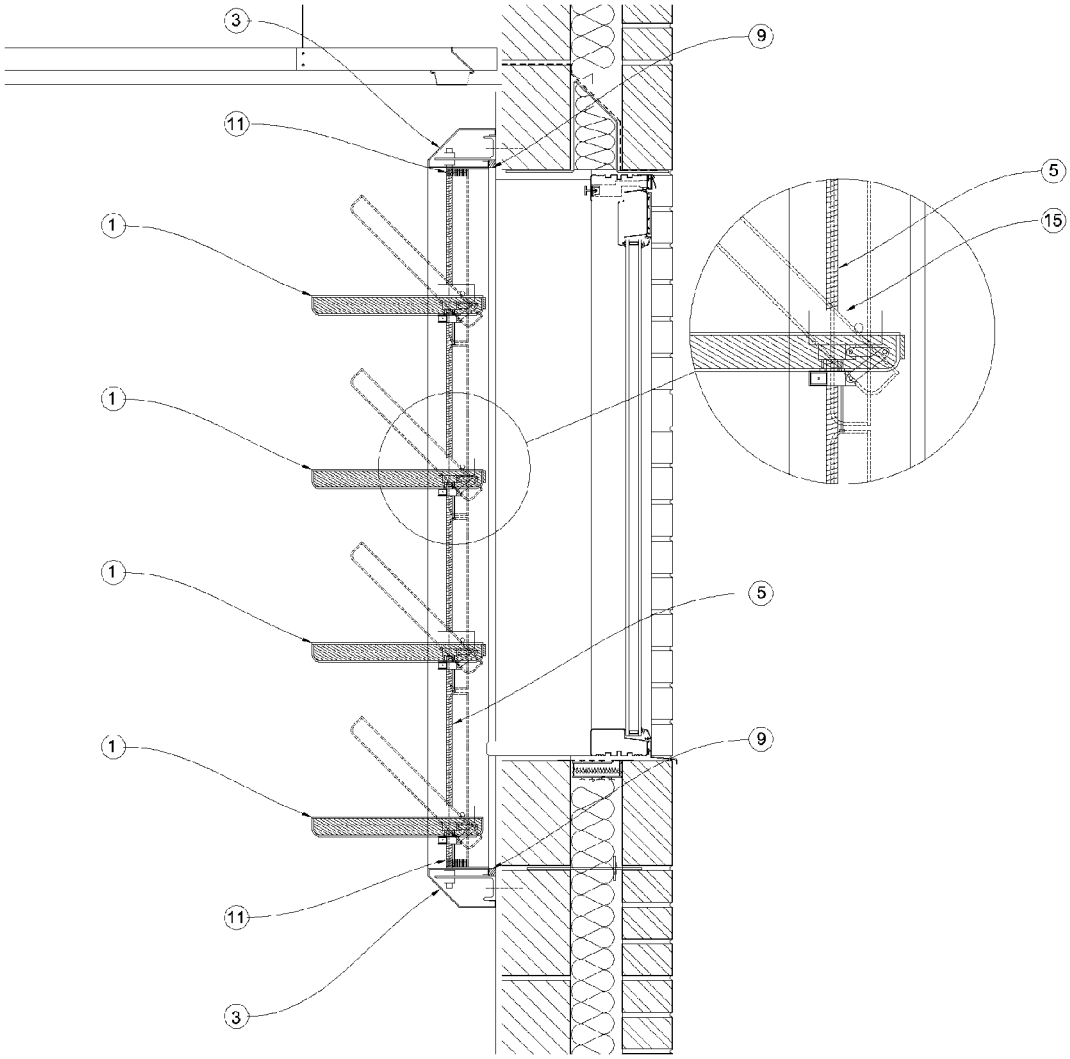
FIG. 4 is a sectional view showing a modification of the thermal shutter system shown in FIGS. 1 and 2.
Figure 5:
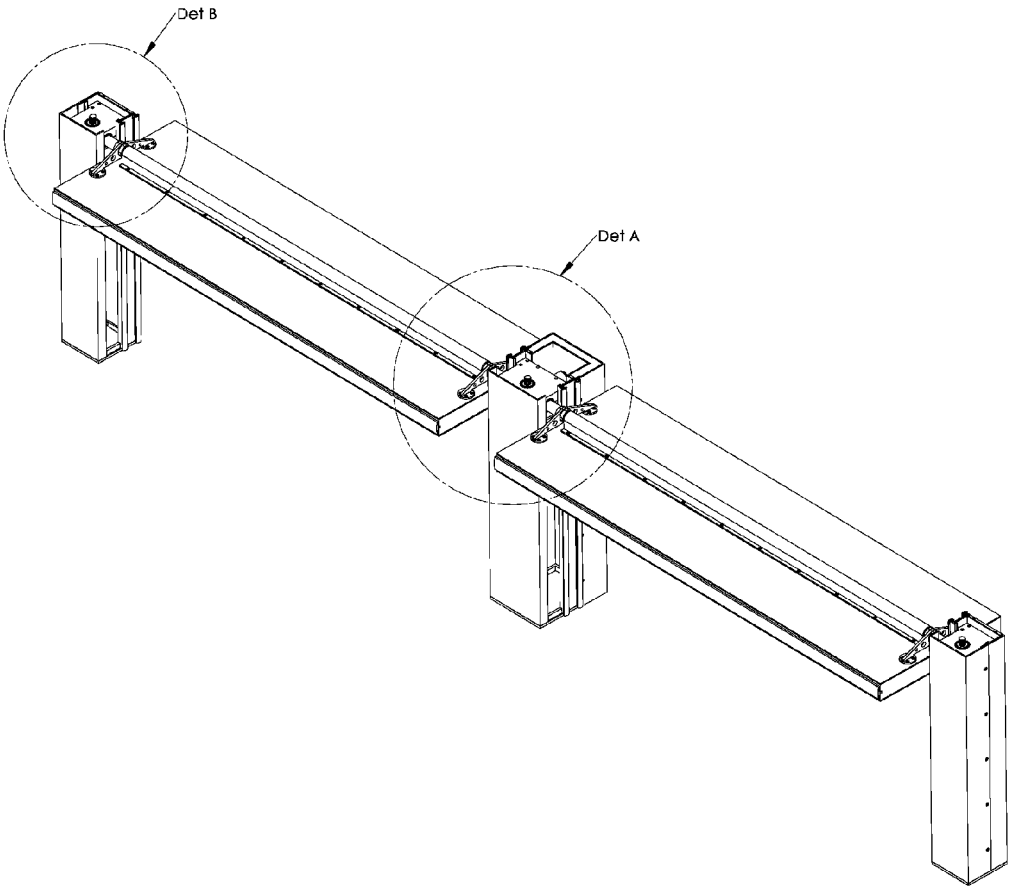
FIG. 5 is a perspective view of another embodiment of a thermal shutter system according to the present invention in a first configuration.
Figure 6:
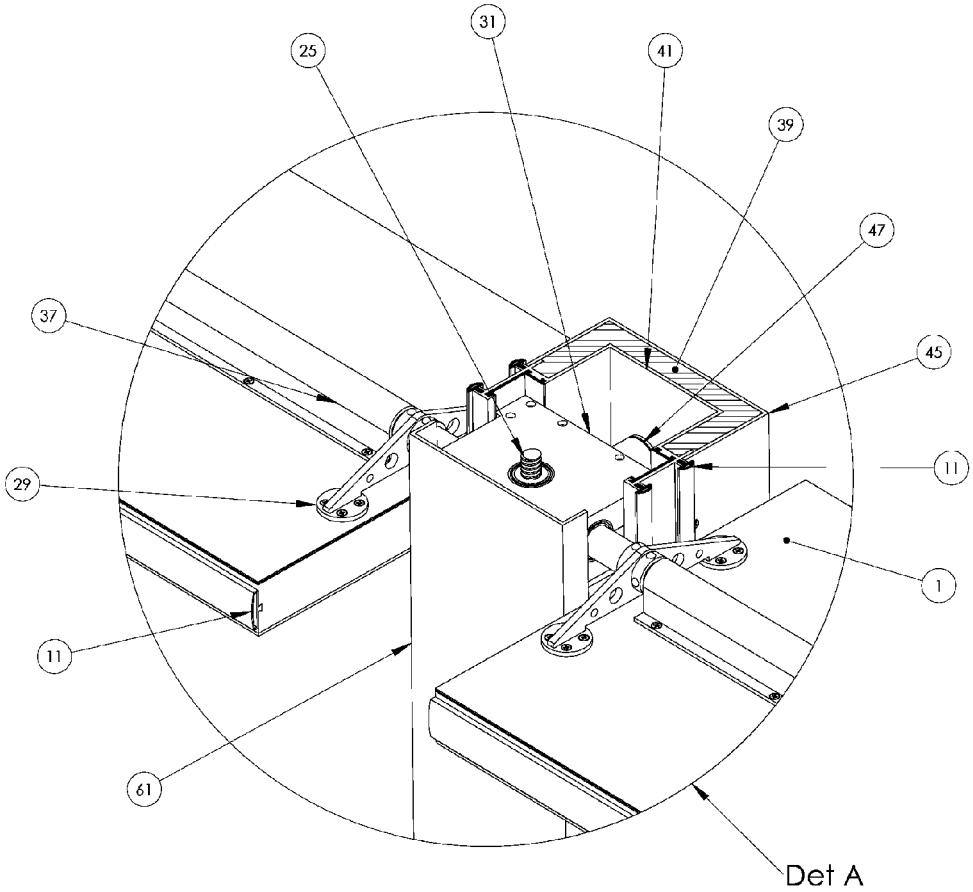
FIG. 6 is a view of the part of FIG. 5 identified as A on a larger scale.
Figure 7:
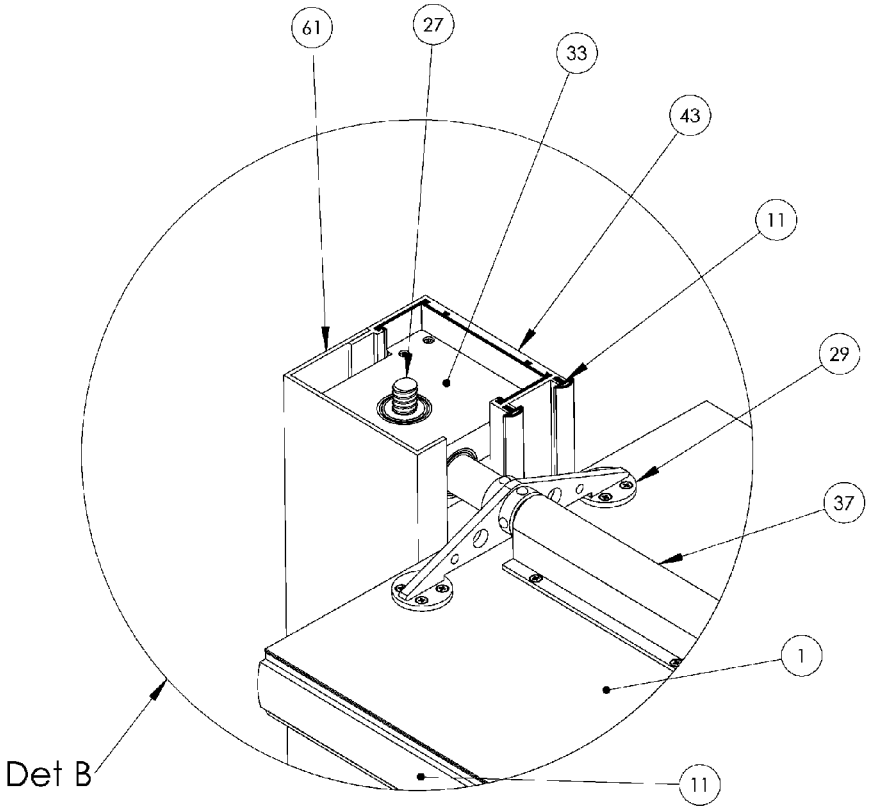
FIG. 7 is a view of the part of FIG. 5 identified as B on a larger scale.
Figure 8:
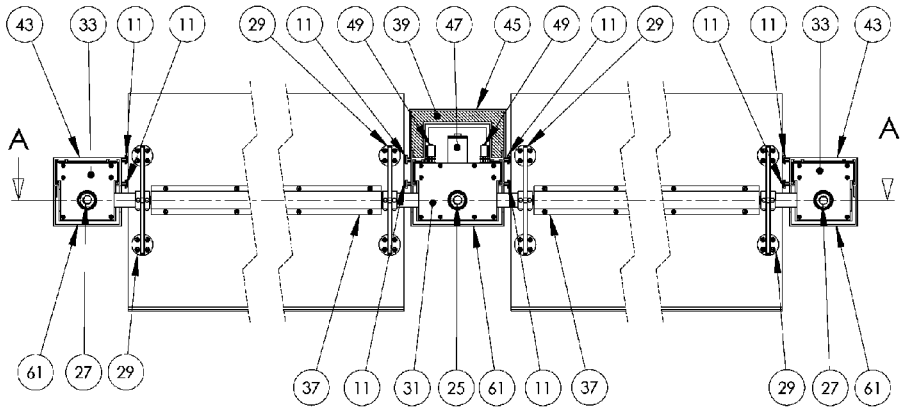
FIG. 8 is a plan view of the thermal shutter system of FIG. 5.

The thermal shutter system shown in FIG. 4 is similar to that shown in FIGS. 1 and 2 except that a motor and gearbox assembly 15 is mounted on the upright member 5 between the upright member and a shutter blade.

The thermal shutter system may be operated manually or may be operated by way of a control panel, for example providing a number of pre-programmed settings in addition to manual and/or user-defined settings. The control system may additionally identify, memorise and adjust the position of the shutter blades based on the time of day and/or the time of the year and the desired functions.

Each blade may be provided with a unique identification which enables the blade to be recognised for repositioning. For example, where a pick and place mechanism is provided, identification may be effected by an optical device which is provided on a common driving system and which identifies each blade by its identification, such as a unique identification code. The elevation and degree of rotation of each blade may be recognised and recorded by one or more local and/or common positioning sensors.

Thus the thermal shutter system according to the present invention can function as a solar shade, as a light shelf and also as a security screen (for example, when a building is unoccupied). The system is able to reduce energy consumption for heating and/or for cooling a building and is also able to reduce energy consumption for lighting by functioning as a light shelf and reducing the need for artificial lighting. The system is also able to reduce glare, for example reducing glare in one part of a building while maintaining natural lighting in another part. The system is also able to provide security for a building, for example acting as a secondary security device when windows are left open for ventilation.

Figure 9:
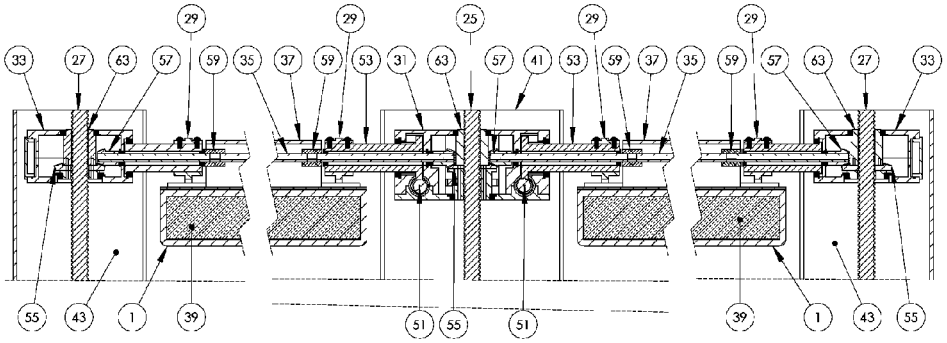
FIG. 9 is a vertical sectional view along the length of the thermal shutter system of FIG. 5.
Figure 10:
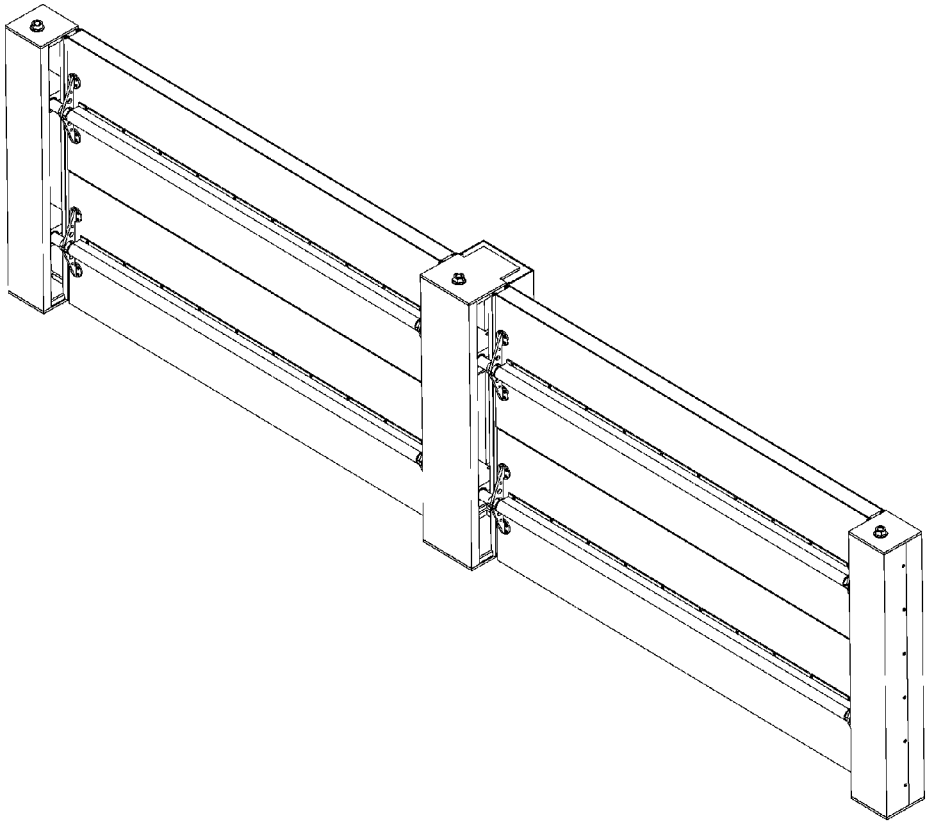
FIG. 10 is a perspective view of the thermal shutter system of FIG. 5 in a second configuration (a first closed configuration)
Figure 11:
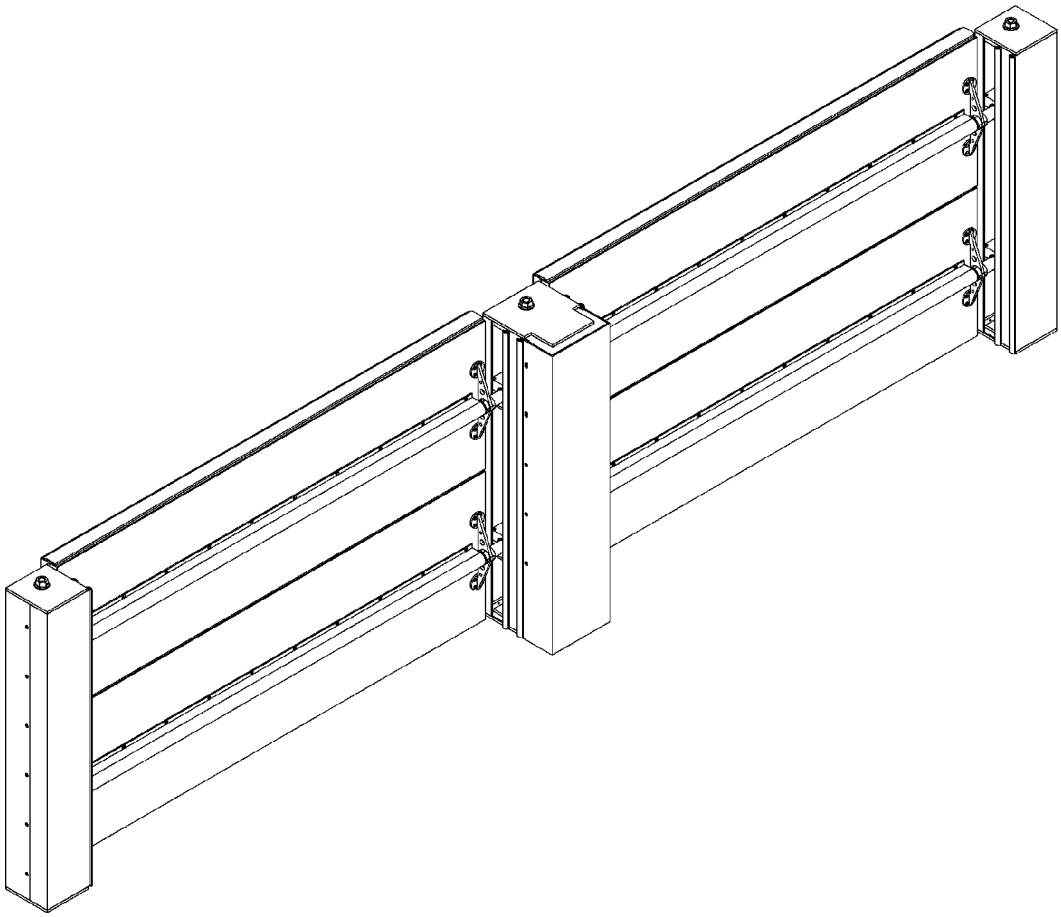
FIG. 11 is a perspective view of the thermal shutter system of FIG. 5 in a third configuration (a second closed configuration).

The thermal shutter system shown in FIGS. 5 to 11 is similar to that of FIGS. 1 to 4, but is in the form of a symmetrical internal shutter system. The thermal shutter system of FIGS. 5 to 11 includes a primary gearbox 31 between two sets of blades 1, and two secondary gearboxes 33 at the sides of the system, the gearboxes being synchronised by means of a lateral shaft 35 which is covered with a protective sleeve 37. Several pairs of blades 1 are provided, the blades being positioned in an end-to-end relationship and being filled with suitable thermal insulating material, such as vacuum insulating panels (VIPs). Each half-blade of a lateral pair of blades rises and falls simultaneously, but each half-blade is able to rotate independently of the other. Seals 11 may be provided between the ends of the half-blades and the frame to provide a seal between the frame and the blades when the half-blades are in an upright configuration as shown in FIGS. 10 and 11. This helps to make the shutter system relatively air-tight (and weatherproof if used externally).

The gearboxes 31, 33 are movably supported on primary 41 or secondary 43 guide tracks forming part of the frame and which may be secured to walls of the building or to a secondary supporting structure. The rear of the primary guide track 41, facing the window of the building, is insulated and provided with a cover 45 of low thermal conduction material to reduce thermal bridging. The fronts of the guide tracks may be provided with covers 61 where the speed of movement of the components of the system is sufficiently fast to present risk of injury when inadvertently touched.

Electrical wiring and electric/electrical equipment for the shutter system is located within the primary guide track 41. Three electric motors are associated with each primary gearbox 31, with a primary motor 47 being provided to effect simultaneous rise and fall of the half-blades and a secondary motor 49 being provided to effect independent rotation of each half-blade.

As shown in FIG. 9, the gearboxes 31, 33 are mounted on three leadscrews, two right-hand leadscrews 27 at the sides and one left-hand leadscrew in the centre (or vice versa). The blades 1 are fixed to the gearboxes by means of spiders 29 with the result that the blades are located in a plane offset from the axis about which they are rotatable. A worm 51 and wheel 53 mechanism is used for rotating the blades 1, while bevel gears 55 and pinions 57 and leadscrew nuts 63 are used, together with the synchronising shafts 35 to effect rise and fall of the blades. As illustrated, leadscrew nuts 63 are attached to the bevel gears 55. Alternatively, though, the gears 55 may be made in such a way as to act as, or to accommodate, a leadscrew nut within the gear. The synchronising shafts 35 are connected to the gearboxes 31, 33 by way of couplings 59.

In addition to the light shelf and shading/glare protection functions described above in relation to the thermal shutter system of FIGS. 1 to 4, because the blades are offset from the wall or surface to which the shutter system is attached, the blades 1 can be placed in different configurations (first and second closed configurations), enabling the fully deployed (closed) shutters to act in two different modes. These are a thermally insulating mode as shown in FIG. 10 and a ventilating mode as shown in FIG. 11. In FIG. 10 the ends of the blades 1 contact the seals 11, while in FIG. 11 the blades have been rotated through 180 degrees and, while closed, there is a space between the ends of the blades and the frame. In either case, the security of a building incorporating the thermal shutter system is not compromised when the building is not occupied.

The invention claimed is:

1. A thermal shutter system comprising a plurality of elongate shutters (1), the shutters being mounted for rotation about the elongate direction thereof and being mounted for movement in a direction substantially perpendicular to the elongate direction, each shutter being movable independently of the other shutter or shutters for both rotation about the elongate direction thereof and also movement in a direction substantially perpendicular to the elongate direction, wherein the shutters (1) are rotatable to provide a first closed configuration, in which the ends of the shutters abut against a seal (11), and a second closed configuration, displaced 180° from the first closed configuration, in which the ends of the shutters are spaced from the seal (11).

2. A thermal shutter system as claimed in claim 1, wherein the shutters (1) are rotatable at any location along a path of movement of the shutters.

3. A shutter system as claimed in claim 1, wherein the shutters (1) are arranged in pairs of subsidiary shutters positioned end-to-end.

4. A shutter system as claimed in claim 2, wherein the shutters (1) are mounted within a frame (3).

5. A shutter system as claimed in claim 1, wherein the seal (11) is selected from a brush seal and an elastomeric seal.

6. A shutter system as claimed in claim 1, wherein the shutters (1) are mounted for rotation about an axis positioned within the shutter.

7. A shutter system as claimed in claim 1, wherein the shutters (1) are arranged in planes offset from the axis about which they are rotatable.

8. A shutter system as claimed in claim 1, wherein the shutters (1) are substantially rectangular.

9. A shutter system as claimed in claim 1, wherein the shutters (1) are opaque, translucent or transparent.

10. A shutter system as claimed in claim 1, wherein the shutters (1) are made of or filled with a thermal insulation material.

11. A shutter system as claimed in claim 1, wherein the shutters (1) are provided at least on one face thereof with a solar panel.

12. A shutter as claimed in claim 1, wherein at least one face of at least one of the shutters (1) is made of or provided with a reflective material.

13. A shutter system as claimed in claim 4, wherein the shutters (1) are mounted on a plurality of linear members (27).

14. A shutter system as claimed in claim 13, wherein the linear members (27) extend within the frame (3).

15. A shutter system as claimed in claim 13 wherein the shutters (1) are mounted for rotation and for movement relative to the linear members (27).

* * * * *